United States Patent [19]

Tiemann

[11] 4,236,096

[45] Nov. 25, 1980

[54] PLASMA IMAGE DISPLAY DEVICE

[75] Inventor: Wilhelm Tiemann, Bubenreuth near Erlangen, Fed. Rep. of Germany

[73] Assignee: Siemens Aktiengesellschaft, Munich, Fed. Rep. of Germany

[21] Appl. No.: 11,720

[22] Filed: Feb. 12, 1979

Related U.S. Application Data

[63] Continuation-in-part of Ser. No. 857,902, Dec. 6, 1977, abandoned.

[30] Foreign Application Priority Data

| | | | |
|---|---|---|---|
| Dec. 14, 1976 | [DE] | Fed. Rep. of Germany | 2656621 |
| Nov. 8, 1977 | [NL] | Netherlands | 7712287 |
| Dec. 13, 1977 | [FR] | France | 77 37570 |
| Dec. 13, 1977 | [GB] | United Kingdom | 51882/77 |
| Dec. 14, 1977 | [JP] | Japan | 52-150396 |

[51] Int. Cl.[2] ..... H01J 1/62; H01J 39/18

[52] U.S. Cl. ..... 313/1; 313/94; 313/485; 313/495

[58] Field of Search ..... 313/1, 2, 94, 483, 485, 313/495

[56] References Cited

U.S. PATENT DOCUMENTS

| | | | |
|---|---|---|---|
| 2,145,295 | 1/1939 | Dowsett et al. | 313/94 X |
| 2,500,929 | 3/1950 | Chilowsky | 313/2 X |
| 2,782,332 | 2/1957 | Sheldon | 313/94 X |
| 2,875,360 | 2/1959 | Kruper | 313/94 |
| 3,107,303 | 10/1953 | Berkowitz | 313/495 X |
| 3,624,442 | 11/1971 | Smithgall et al. | 313/2 |
| 3,686,686 | 8/1972 | Hall | 313/485 X |
| 3,886,393 | 5/1975 | Hinson | 313/225 X |
| 3,951,698 | 4/1976 | Wilson et al. | 313/94 X |

*Primary Examiner*—Palmer C. Demeo

*Attorney, Agent, or Firm*—Kenyon & Kenyon

[57] ABSTRACT

A plasma image display device with a gas discharge space and an electron acceleration space in which the gas discharge space is divided off from the electron acceleration space by a light transparent, high vacuum tight partition having a side facing a fluorescent screen which is provided with a photo cathode as an electron source to provide, due to high accelerating voltages, a high image amplification and good image definition.

12 Claims, 9 Drawing Figures

Fig. 2.
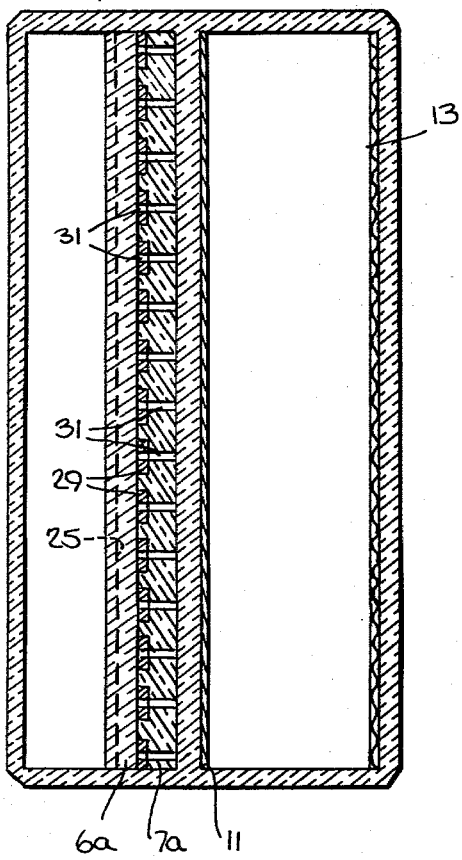
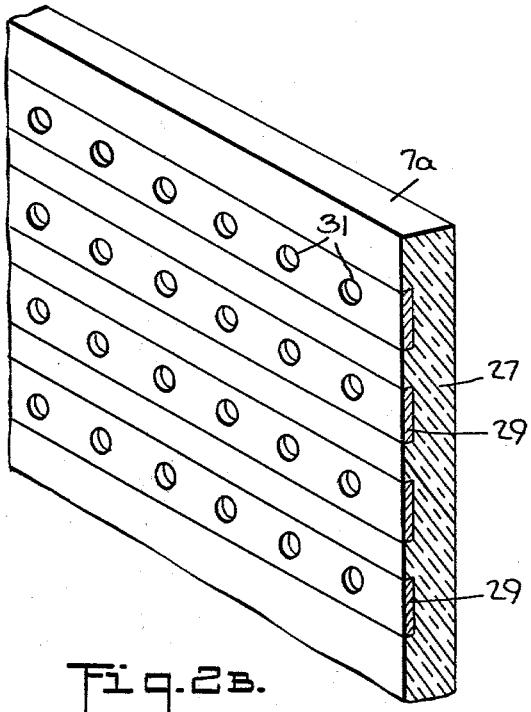
Fig. 2B.
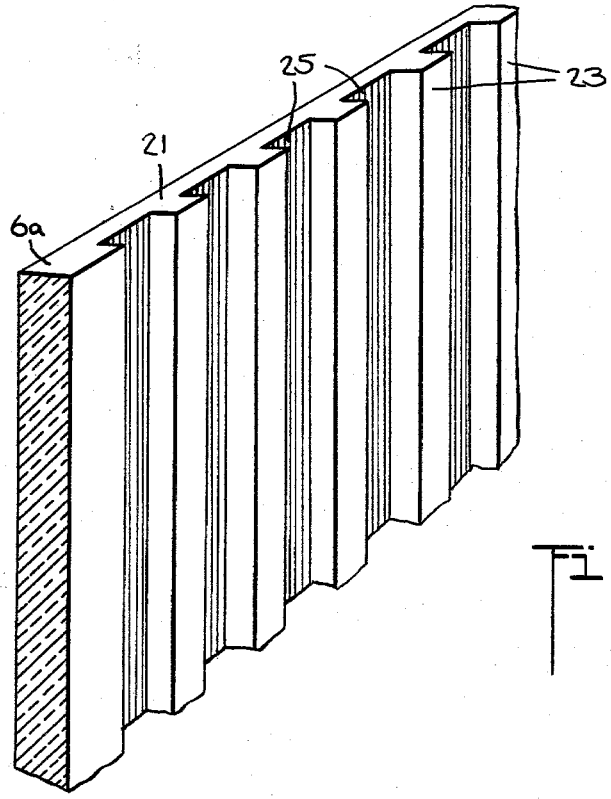
Fig. 2A.

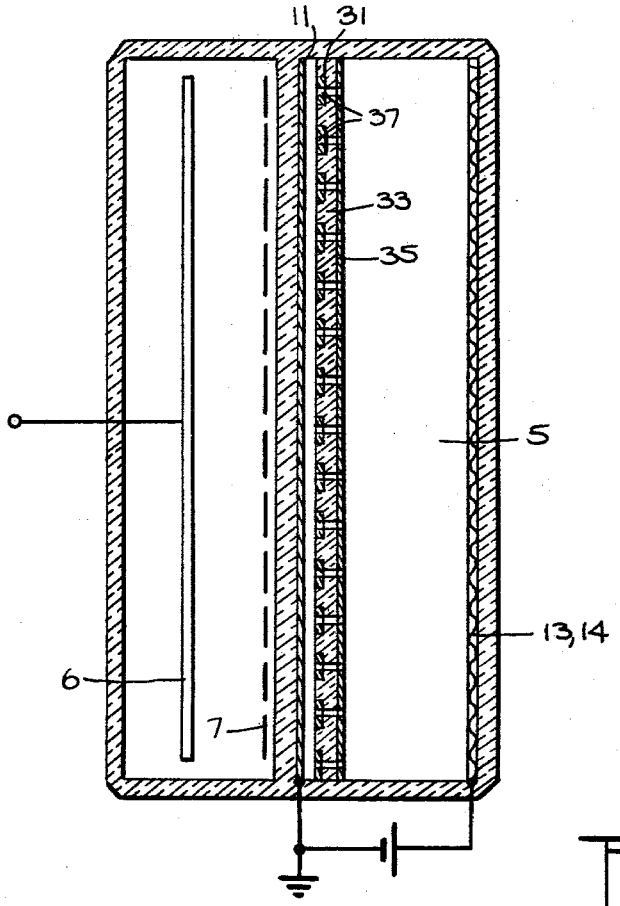
Fig. 3.
Fig. 3A.
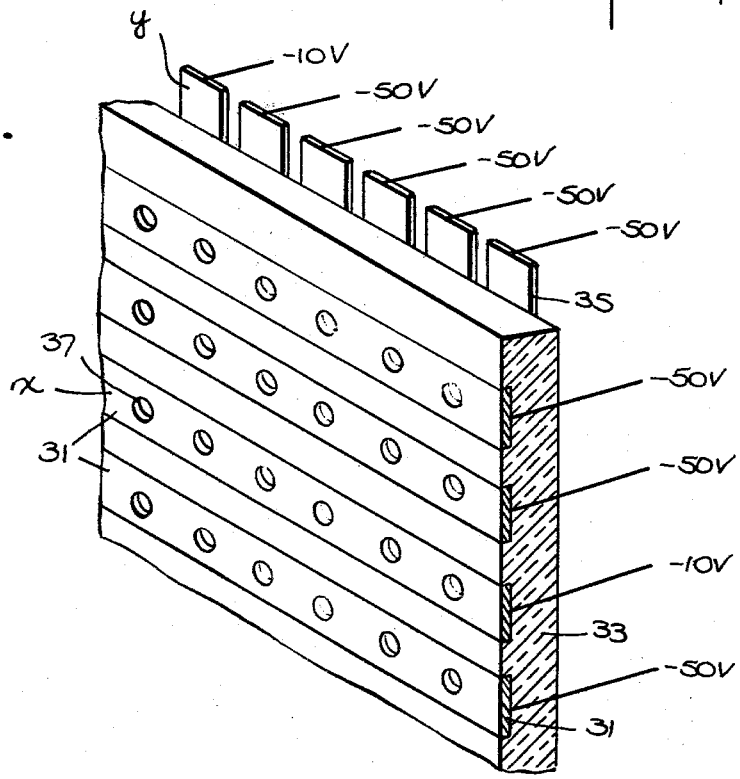

Fig. 4.
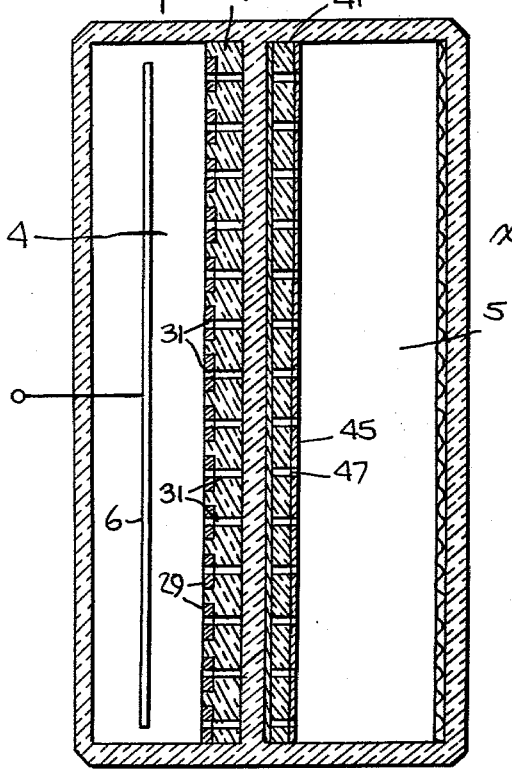
Fig. 4B.
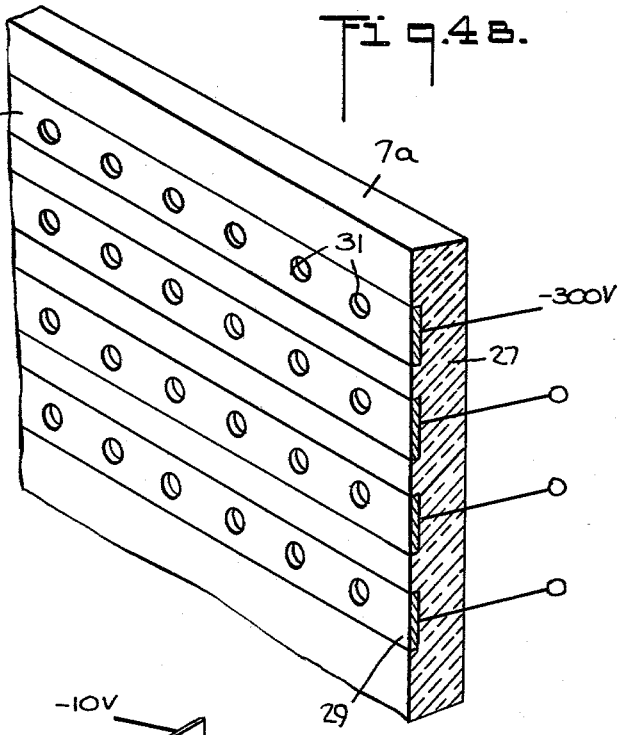
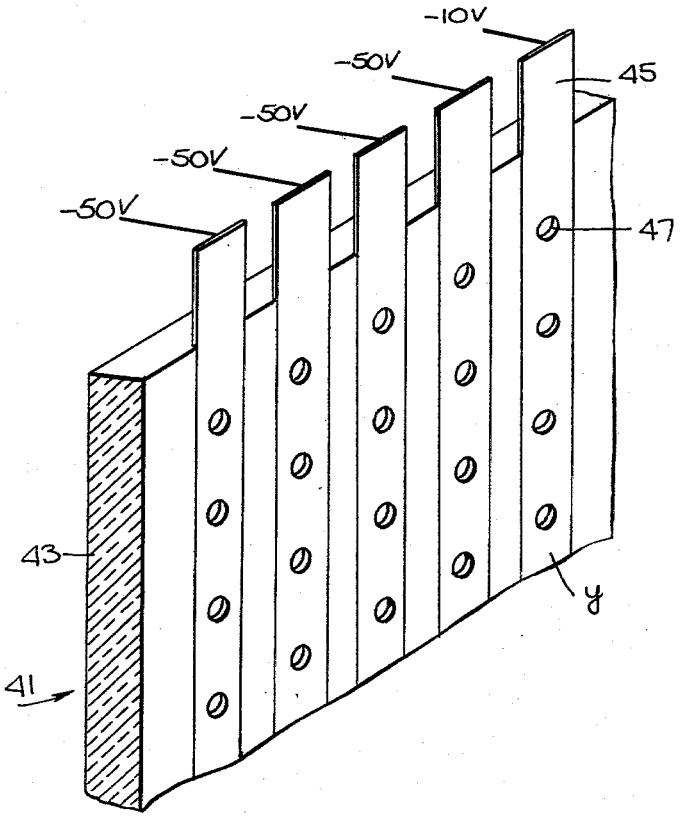
Fig. 4A

PLASMA IMAGE DISPLAY DEVICE

RELATED APPLICATIONS

This application is a continuation-in-part of application Ser. No. 857,902, filed Dec. 6, 1977, and now abandoned.

BACKGROUND OF THE INVENTION

The invention relates to plasma image display devices in general, and more particularly to an improved plasma image display device.

A plasma display device comprising a gas-tight envelope, the interior of which is divided into a gas discharge space and an electron acceleration space which contains an image screen with fluorescent phosphors, and auxiliary electrodes for line scanning and further auxiliary electrodes, arranged perpendicularly thereto, for brightness control is known.

This device contains a matrix of gas discharge cells, having associated anodes for controlling the rows and control electrodes for controlling the brightness of the columns. In the interior of the gas-tight envelope of this image display device, an auxiliary gas discharge path between a cathode and the auxiliary anodes is provided along with an electron accelerating path between the control electrodes and an anode. A hole matrix consisting of a plate of insulating material divides the common interior of the envelope into an auxiliary discharge space of relatively great length for the gas discharge current, operating at low voltage, and a second space with a short travel distance and high field strength for accelerating the electrons. The insulating hole matrix serves as the carrier for the auxiliary anodes associated with the cells of the matrix. The control electrodes for the brightness control of the columns may be arranged on the opposite flat side of the matrix. The electrons which are generated by the auxiliary glow discharge in a controlled row by row manner and are moved toward the auxiliary electrode, are controlled element by element in the following discharge path of high field strength by the correspondingly subdivided control electrode, accelerated toward the anode and imaged on the latter's fluorescent screen. The anode is preferably designed as a continuous (non-mosaic) screen electrode. On it, the electrons are imaged as defined picture elements. If a row of the auxiliary electrodes is energized, the discharge glows uniformly along the entire electrode, while the negative glow covers a region, the area of which is determined by the well known dependence of the current density at the cathode and by the gas pressure.

In this embodiment of an image display device, the glow discharge space is therefore not separated from the acceleration space. For this reason, the choice of the kind of gas, the gas pressure and the cathode material must be made such, in the known image display device, that, on the one hand, an optimum glow discharge with, in particular, maximum current density is made possible in the glow discharge space, but that, on the other hand, the firing of an independent discharge, which is also called a dielectric breakdown and which prevents an electron beam from being generated, is precluded in the acceleration space. The magnitude of the accelerating voltage is therefore fixed in the known image display device by the choice and the pressure of the gas charge to a predetermined maximum value, which also determines the luminous density of the phosphor image screen.

SUMMARY OF THE INVENTION

It is now an object of the present invention to improve this known device. It should, in particular, be possible to further increase the accelerating voltage and thereby, the luminous density. According to the present invention, this problem is solved for a plasma image display device of the aforementioned type by separating the gas discharge space from the electron acceleration space with a light transparent, high vacuum tight partition, whose side facing the fluorescent screen is provided with a photocathode as an electron source.

According to the present invention, the fluorescent phosphors on the fluorescent screen are excited by electron rays. The photocathode in the high vacuum, opposite which the aluminized fluorescent screen is disposed at a small distance of a few millimeters, is used as the electron source. The electrons released from the photo cathode are accelerated by a high voltage of about 10 to 20 kV between the photocathode and the aluminum film on the fluorescent screen. The photocathode is applied to the inside of the light transparent, gas-tight partition, which may have the form of a plane glass window of large area. The negative glow of the glow discharge in the gas discharge space serves as the light source which excites electron emission of the photocathode through this window. The glow discharge makes it possible to fabricate the light source as a very shallow structure and, if desired, over a large area.

Since the electron acceleration space is separated from the gas discharge space, in a gas-tight manner, there are practically no interactions between these spaces. Since a high vacuum prevails in the electron acceleration space, high accelerating voltages can be provided without danger of a dielectric breakdown. With a high accelerating voltage, a relatively high image amplification and good image definition ("proximity focus") are obtained. In addition, the electrons penetrate the aluminum film, which must generally be provided for the fluorescent screen, relatively easily without the occurrence of brightness differences due to different thicknesses of aluminization. There is furthermore practically no danger of electrons being scattered at gas particles that are still present in the highly evacuated electron acceleration space. This too, contributes to the high image definition. Since the formation of ions is also not possible in the acceleration space, brightness control of the auxiliary electrodes that may be provided in this space, can be effected with a relatively small amount of driving power.

It is furthermore possible to easily adapt the glow discharge to the photocathode, for instance, by the choice of the base gas required for the glow discharge. In addition, a further adaptation can also be obtained by admixing a suitable supplemental gas to the base gas. Such a supplemental gas is advantageously mercury vapor, by which the ultraviolet content of the glow light can be increased. A further parameter for adaptation is the gas pressure.

The photocathode can also be adapted to the spectrum produced by the glow discharge by a suitable choice of the spectral type of the photo cathode.

BRIEF DESCRIPTION OF THE DRAWINGS

FIG. 2 is a similar view of a second embodiment in which a cathode plate and anode plate are used for line scanning and brightness control.

FIG. 2A is a perspective view of the anode plate of FIG. 2.

FIG. 2B is a perspective view of the cathode plate of FIG. 2.

FIG. 3 is a cross-sectional schematic view of a third embodiment of the present invention having a control plate for line scanning and brightness control in the electron acceleration space.

FIG. 3A is a perspective view of the control plate of FIG. 3.

FIG. 4 is a cross-sectional schematic view of a fourth embodiment of the present invention having a first control plate in the form of a cathode in the gas discharge space and a second control plate in the electron acceleration space.

FIG. 4A is a perspective view of the second control plate of FIG. 4.

FIG. 4B is a perspective view of the first control plate of FIG. 4.

DETAILED DESCRIPTION OF THE INVENTION

Figure 1:
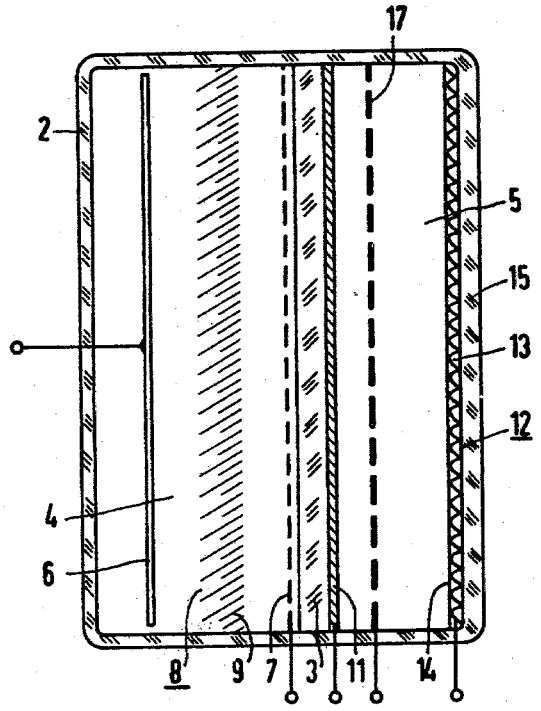
FIG. 1 is a schematic illustration of a first embodiment of a television imaging tube according to the present invention.

In FIG. 1, part of a television picture tube is schematically indicated in a cross section. The tube contains a gas tight envelope, for instance, a glass body 2, the interior of which is subdivided into two separate spaces 4 and 5 by a partition 3. One of these spaces, 4, is designed as the gas discharge space and contains an anode 6 at a predetermined potential of, say, 200 V, opposite which a light transparent screen electrode 7 is provided on the partition 3. The gas discharge space 4 is filled with a gas, for instance, neon, with a pressure of several Torr. Small amounts of an additional gas such as mercury vapor, for instance, can be further admixed to this gas. This can particularly reduce cathode sputtering. A glow discharge, the glow of which is indicated by a shaded front 8, is generated between the anode 6 and the cathode 7, which is for instance, at zero potential. The side 9 of this glow which faces the partition 3 is called negative glow and forms a sharply defined front opposite the cathode 7 and the partition 3. The photons emitted by a negative glow can penetrate the partition 3, which consists of a light transparent material and arrive at a photocathode 11 which is arranged on the side of the partition, bounding the acceleration space 5. In this electron acceleration space 5, there preferably prevails a high vacuum of better than $10^{-6}$ Torr. The incident photons release electrons at the photocathode 11. On the side of the electron acceleration space 5 opposite the photocathode 11, a fluorescent screen 12 is arranged which contains a layer of fluorescent phosphors 13 which are covered and separated from the electron acceleration space 5 by a thin aluminum film 14. The fluorescent phosphors 13 are applied to a frontal glass window 15, which points in the direction of a viewer, not shown in the figure. A high voltage of 10 to 20 kV is applied between the photocathode and this aluminum film 14. This high voltage accelerates the electrons leaving the photocathode causing them to penetrate the aluminum layer and impinge on the fluorescent phosphors, where they generate a picture element.

For the sake of clarity, the auxiliary electrodes required for line stepping in a picture tube and the further auxiliary electrodes for brightness control, which are arranged perpendicular thereto, are not detailed in the figure. These electrodes can be arranged in the gas discharge space 4 as well as in the electron acceleration space 5 jointly or, alternatively, separated by the partition 3. If desired, a further screen-like grid may be provided in the electron acceleration space 5 as indicated in the figure by a dashed line 17; by means of grid 17, secondary electrons for amplifying the electron beam emanating from the photocathode 11 can be generated. Thereby, a further increase in the brightness of the fluorescent phosphors 13 can be obtained.

A potential difference of about 200 V may be provided, for instance, between this grid 17 and the photocathode.

FIGS. 2, 2A and 2B illustrate another embodiment of the present invention. In this particular embodiment, the fluorescent phosphors 13 are the same as before as is the photocathode 11. However, in this embodiment, an anode plate **6*a* and cathode plates 7*a* are used in place of the anode and cathode 6 and 7 of FIG. 1. These form, at the same time, the auxiliary electrode for line scanning and further auxiliary electrode for brightness control, which are jointly disposed in the gas discharge space. The anode plate 6*a* is shown in perspective view on FIG. 2*a*. It includes a plate 21 of insulating material such as glass or ceramic having formed therein a plurality of grooves 23 with the base of each of the grooves containing a metal coating to form a conductive strip 25. Each of the conductive strips 25 forms a separate control electrode. As illustrated by FIG. 2, the anode plate abuts against the cathode plate 7*a* which is shown in perspective view on FIG. 2B. The cathode plate also comprises a plate 27 of an insulating material and has recessed therein a plurality of strip electrodes 29. Rows of holes 31 are formed opposite the grooves 23 of the anode plate. Although only a few holes are shown, in a practical embodiment, each strip could contain, for example, up to 1500 holes to obtain the desired resolution. Naturally, this would require a corresponding number of grooves in the anode plate. The conductive strips, both in the anode and cathode plates, can be formed using conventional evaporation deposition techniques. What occurs is that at each cross point of a cathode strip 29 and anode strip 25, at the location of the holes 31, there is formed a single discharge cell, the discharge from which acts upon the photocathode 11 in the manner explained above. Through separate control of the conductive strips 25 in conjunction with the conductive strips 29 a discharge can be then selected at any one of a plurality of specific points. One particular advantage of this embodiment is that by using a cathode plate with metal strips containing holes with a predetermined thickness of the plate, a focusing can also be obtained. By focusing the photons a correspondingly sharp spot of small diameter is generated on the photocathode which is not much larger than the diameter of the holes in the cathode plate 7*a***.

FIG. 3 illustrates auxiliary electrodes for line control and column control jointly disposed in the electron acceleration space 5. The electrodes 31 which are used for control purposes are embeded in an insulating plate 33, much in the manner of the electrodes shown in connection with the cathode plate of FIG. 2B. They are always arranged on a flat side of the plate 33. The plate 33 comprises an insulating material such as glass or ceramic and also contains a matrix of holes. Each horizontal row of holes is disposed in one of the metal conductor strips 31. The metal strips 31 are the electrodes for line control. On the opposite side of the plate 33 are auxiliary electrodes for brightness control. This is shown in more detail on FIG. 3A. Here the electrodes 35 which extend perpendicular to the electrodes 33 and which are used for brightness control are shown. The electrodes shown in this embodiment do not act as an anode or cathode, but are used to control the passage of electrons through the device. As long as a relatively high negative potential of, for example, 50 volts with respect to ground is applied to an auxiliary electrode 31, all holes of the control plate associated with that electrode are closed and prevent electrons from passing through. A high voltage is applied between the photocathode 11 and the fluorescent screen 14, for example, up to 15 kV. Because of the effect of this high voltage, the electrons released from the photocathode would, as such accelerate to the image screen 13. However, they are prevented from passing through the hole matrix of the control plate 33 because of the negative potential of the control electrode. However, when a considerably reduced negative potential of, for example, −10 volts is applied to one of the vertical column electrodes 35, i.e., the one designated "y" on FIG. 3A, and simultaneously to one of the line electrodes 31 of FIG. 3A, e.g., the one designated "x" on FIG. 3A, electrodes arriving at a hole, for example, the hole 37, which occurs at the cross point of the two electrodes to which −10 volts is applied, can pass through. Only at this single control element which is thus formed will the electrodes travel from the photocathode 11 to the screen 13, and at this spot form a point of predetermined brightness.

FIG. 4 illustrates a further embodiment of the present invention. In this embodiment, in the gas discharge space 4, the auxiliary electrodes for line control are formed by the conductive strips 29 of a cathode plate 7*a* of the type described above in connection with FIG. 2B. The auxiliary electrodes for the brightness control which are in the form of columns are disposed in the electron acceleration space 5 on a control plate 41. Control plate 41 is illustrated on FIG. 4A. As with the previously described plates, it includes a plate 43 of insulating material on which are deposited electrodes 45. Arranged in rows and columns are a plurality of holes 47. Again, associated with this plate are shown various voltages.

The control plate for the line control, which is the same as the plate of FIG. 2B is illustrated on FIG. 4B with appropriate voltages indicated. Thus, only the uppermost conducting strip 29 has a potential of −300 volts, whereas the rest are held at ground. Similarly, only one of the column electrodes 45 of the control plate 41 of FIG. 4A has a voltage of −10 volts instead of −50 volts. Thus, only where a hole 31 and a hole 47 line up at the intersection of the brightness control electrode 45 and the cathode electrode 29 having the −300 volts applied thereto will an electron both be generated and be permitted to pass through the control plate 41. For example, in operation, the cathode plate of FIG. 4B will be used for line scanning with the electrodes 29 energized one at a time with −300 volts. Gas discharges will then occur in all of the holes 31 across that line. The glow discharge will stimulate electron emission by the photocathode 11 in the manner described above, again, only across a line. And, through control of the brightness electrodes 45, only one of which is shown as having the −10 volts applied thereto, only at a single spot at the location of the hole 47 associated with that electrode will a spot be allowed to be generated on the screen, since only through that hole will electrons be permitted to pass. The remaining electrons which will be generated, for example, across the top row of holes 47 will be blocked by the −50 volt potential on those electrodes of control plate 43.

In each case, the two sets of electrodes, e.g., the electrodes 45 and the electrodes 29, are at right angles to each other. It will be recognized by those skilled in the art that both of the control plates, i.e., the cathode plate 7*a* and the control plate 41 can be rotated 90°. In that case, the electrodes in the electron acceleration space will act as a line control and the auxiliary electrodes in the gas discharge space, i.e., the electrodes on the cathode plate will provide column control. This embodiment has not been illustrated specifically since it is simply a modification of what has been illustrated.

In the embodiment of auxiliary electrodes described herein, the columns in the gas discharge chamber are not switched on consecutively. Rather, the column electrode through which it is desired to pass photons are provided with a reduced control potential.

It should again be noted that, in the embodiment of FIGS. 2, 2A and 2B, no further control electrodes are required since full control is maintained by means of the cathode and anode, i.e., the cathode plate carries out line scanning and the anode plate column scanning.

In general, in each of the embodiments of FIG. 2, FIG. 3 and FIG. 4, there is formed a hole matrix which aids in focusing the image on the screen. Associated with the hole matrix are means for line scanning, e.g., conductive strips 29 in FIGS. 2 and 2B, 31 in FIGS. 3 and 3A, or 29 in FIGS. 4 and 4B and further means for brightness (column) control, e.g., conductive strips 25 of FIG. 2A, electrodes 35 of FIG. 3A and electrodes 45 of FIG. 4A.

The device according to the invention is particularly well suited for the design of flat picture tubes for reproducing color television pictures.

What is claimed is:

1. A plasma image display device comprising:

(a) a gas-tight envelope;

(b) a light transparent high vacuumtight partition subdividing the interior of said gas-tight envelope into a gas discharge space and an electron acceleration space;

(c) a picture screen with fluorescent phosphors on a surface of said gas-tight envelope opposite said partition in said electron acceleration space;

(d) a thin aluminum film separating said phosphors from said electron acceleration space;

(e) at least one anode disposed in said gas discharge space;

(f) at least one screen electrode disposed in said gas discharge space, said screen electrode forming a cathode;

(g) a gas under pressure filling said gas discharge space whereby a gas discharge will be generated between said anode and cathode;

(h) a photocathode forming an electron source on the side of said partition facing said fluorescent screen, in said electron acceleration space;

(i) means adjacent said fluorescent screen to which a high voltage can be applied to accelerate electrons leaving said photocathode to cause them to penetrate the aluminum film and impinge on the fluorescent phosphors, said electron acceleration space being maintained under a high vacuum;

(j) means for obtaining line scanning and further means for obtaining brightness control arranged perpendicular thereto;

(k) a hole matrix cooperating with said means for obtaining and further means for obtaining to achieve focusing; and (l) said means for obtaining and further means for obtaining disposed in either the gas discharge space or electron acceleration space whereby, the negative glow of the glow discharge in the gas discharge space will serve as a light source to excite electron emission of the photocathode through said partition, the electrons released from the photocathode then being accelerated by a high voltage applied between said photocathode and said aluminum film to accelerate the electrons leaving the photocathode causing them to penetrate the aluminum film and impinge on the fluorescent phosphors, with said hole matrix achieving focusing, whereby they will generate a focused picture element.

2. The display device according to claim 1, wherein said means for obtaining line scanning and said further means for obtaining brightness control are jointly arranged in the gas discharge space.

3. The display device according to claim 2 wherein said anode comprises an insulating plate having a plurality of grooves therein at the bottom of which there is a metal coating, said metal coating forming auxiliary electrodes for brightness control and wherein said cathode comprises an insulating plate containing therein a plurality of metal strip electrodes forming a further auxiliary electrode for line scanning, said hole matrix comprising holes formed behind said electrodes in said cathode plate.

4. The display device according to claim 1 wherein said means for line scanning and further means for brightness control comprise respectively, auxiliary electrodes for line scanning and further auxiliary electrodes for brightness control jointly arranged in said electron acceleration space.

5. The display device according to claim 1 wherein said means for obtaining line scanning and further means for obtaining brightness control comprise auxiliary electrodes and further auxiliary electrodes disposed on opposite sides of an insulating plate forming rows and columns mutually perpendicular to each other, and wherein said hole matrix comprises a hole at each intersection of an auxiliary electrode and further auxiliary electrode.

6. The display device according to claim 1 wherein one of said means for line scanning and further means for brightness control are arranged in the gas discharge space, and the other in the electron acceleration space.

7. The display device according to claim 6 wherein said means for line scanning are arranged in the gas discharge space and further means for brightness control in the electron acceleration space.

8. The display device according to claim 6 wherein said means for line scanning are arranged in the electron acceleration space and further means for brightness control in the gas discharge space.

9. The display device according to claim 6 wherein one of said means for line scanning and further means for brightness control comprise a cathode plate of insulating material having disposed therein a plurality of metal electrode strips parallel to each other, disposed in said gas discharge space and the other of said means for line scanning and further means for brightness control comprise a control plate of insulating material having disposed thereon a plurality of metal strip electrodes parallel to each other and perpendicular to the electrodes of said cathode plate, said hole matrix comprising holes formed in each of said plates at the locations of the intersections between said two sets of metal electrode strips.

10. The display device according to claim 1 and further including a secondary electron emission grid arranged in the electron acceleration space.

11. The display device according to claim 1 and further including a small amount of supplemental gas admixed to said base gas wherein said gas discharge space contains a base gas required for a glow discharge in the gas discharge space.

12. The display device according to claim 11 wherein said supplemental gas is mercury vapor.

* * * * *